US006647588B2

(12) United States Patent
Gooden

(10) Patent No.: US 6,647,588 B2
(45) Date of Patent: Nov. 18, 2003

(54) TEMPORARY SECURING DEVICE FOR A STAIR RUNNER

(76) Inventor: Tony Gooden, 2139 - 10th Avenue, Medicine Hat, Alberta (CA), T1A 8B7

( * ) Notice: Subject to any disclaimer, the term of this patent is extended or adjusted under 35 U.S.C. 154(b) by 17 days.

(21) Appl. No.: 10/045,502

(22) Filed: Nov. 7, 2001

(65) Prior Publication Data

US 2002/0062532 A1 May 30, 2002

(30) Foreign Application Priority Data

Nov. 7, 2000 (CA) ..... 2325184

(51) Int. Cl.[7] ..... A47G 27/04
(52) U.S. Cl. ..... 16/10; 16/12
(58) Field of Search ..... 16/10, 11, 12; 248/267, 268, 262, 254, 251, 252; 211/105.1, 105.3, 105.5, 105.6; 4/610, 611

(56) References Cited

U.S. PATENT DOCUMENTS 656,551 A * 8/1900 Knobeloch ..... 16/11
664,545 A * 12/1900 Gould ..... 16/12
772,829 A * 10/1904 Russell, Jr. ..... 211/105.4
1,013,345 A * 1/1912 Welsh ..... 16/11
1,126,361 A * 1/1915 Billestein ..... 16/11
1,397,618 A * 11/1921 Burns ..... 16/12
1,685,679 A * 9/1928 Muentener ..... 16/12
3,951,269 A * 4/1976 Anderson ..... 211/105.4
4,076,437 A * 2/1978 Mazzolla ..... 403/350
4,632,597 A * 12/1986 Clausen et al. ..... 403/351
5,330,061 A * 7/1994 Geltz ..... 211/105.4
5,799,346 A * 9/1998 Tiernan ..... 4/601

FOREIGN PATENT DOCUMENTS

GB 215325 A * 9/1985

* cited by examiner

*Primary Examiner*—Chuck Y. Mah
(74) *Attorney, Agent, or Firm*—Frost Brown Todd LLC; Kevin S. Sprecher, Esq.

(57) ABSTRACT

A device for temporarily securing a stair runner on a staircase comprises an elongated shaft. An extension member extends from a first end of the shaft and is biased outward from the first end of the shaft, such that the extension member is movable from an extended position to a retracted position. A second end of the shaft and the distal end of the extension member terminate in a head adapted to grip a surface and resist lateral movement. The length of the device when the extension member is in the retracted position is less than a width of a stair. A handle extends substantially radially from the shaft.

15 Claims, 2 Drawing Sheets

TEMPORARY SECURING DEVICE FOR A STAIR RUNNER

This invention is in the field of safety equipment and in particular a device for temporarily securing a stair runner to protect floors when moving furniture and the like.

BACKGROUND

Furniture movers take all possible steps to prevent damage to floors. Commonly, runners are employed particularly on hallways, stairs and high traffic areas. The runner is a fabric material laid down over the floor, and commonly is rubber-backed to prevent slipping.

Stairways present a safety threat when runners are used, because there is presently no way to secure the runner in place. It is common to see the movers push the runner back in place every time an item is carried up or down the stairs. Even with a rubber back the stair runner will move, creating a wrinkle which can trip a mover. Movers often lose patience with the stair runner and remove it. The mover must then often clean or repair damage caused to the floor.

Permanently installed stair runners are known, and held in place by adhesive or by a rod along the bottom of each stair riser. For temporary use these methods and devices are not practical because of the damage caused by the adhesive or fasteners.

SUMMARY OF THE INVENTION

It is the object of the present invention to provide a device for temporarily securing a stair runner on a staircase.

It is a further object of the invention to provide such a device that may be quickly adapted for use on various commonly encountered staircase surfaces.

The invention provides, in one aspect, a device for temporarily securing a stair runner on a staircase. The device comprises an elongated shaft; an extension member extending from a first end of the shaft, and having a distal end removed from the shaft and a proximate end; wherein the extension member is biased outward from the first end of the shaft, such that the extension member is movable from an extended position to a retracted position; a second end of the shaft and the distal end of the extension member terminating in a head, the head adapted to grip a surface and resist lateral movement of the head; wherein a length of the device when the extension member is in the retracted position is less than a width of a stair; and a handle extending substantially radially from the shaft.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
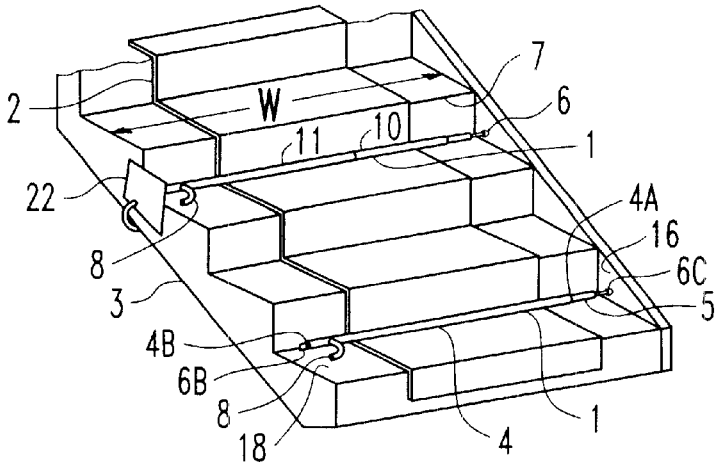
FIG. 1 is a perspective view of a staircase with a stair runner secured thereon by devices of the invention.
Figure 2:
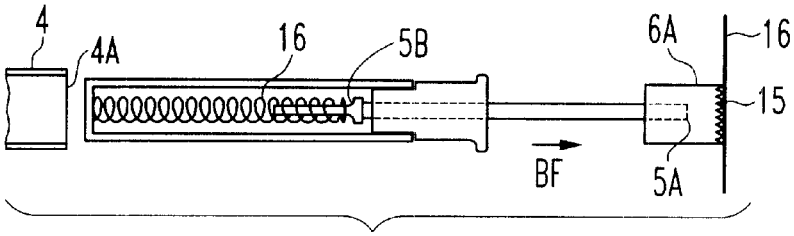
FIG. 2 is a schematic side view of a bias element, extension member and attached head.

FIG. 1 illustrates a device 1 for temporarily securing a stair runner 2 on a staircase 3. The device 1 comprises an elongated shaft 4. An extension member 5 extends from a first end 4A of the shaft 4, and has a distal end 5A removed from the shaft and a proximate end 5B. The extension member 5 is biased outward from the first end of the shaft 4, such that the extension member 5 is movable from an extended position EP to a retracted position RP. As illustrated in FIG. 2, the proximate end 5B of extension member 5 is located in a hollow portion 4H in the first end 4A of the shaft 4. A bias element is provided by a spring 16 mounted in the hollow portion 4H and exerting an outward bias force BF on the extension member 5.

The opposite second end 4B of the shaft 4 and the distal end 5A of the extension member 5 terminate in a head 6 adapted to grip a surface and resist lateral movement thereof. The length DL of the device 1 when the extension member 5 is in the retracted position RP is less than a width W of the stair 7. A handle 8 extends substantially radially from the shaft 4.

Figure 15:
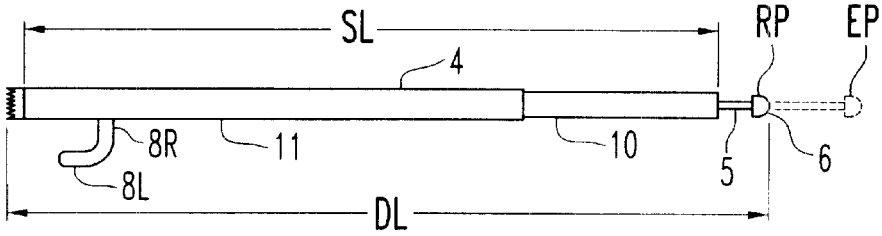
FIG. 15 is a side view of a device with telescoping members allowing adjustment for various widths of staircases.

As best illustrated in FIG. 15, the handle 8 extends radially outwards from the shaft and also towards the second end 4B of the shaft 4. The radial extension 8R allows the operator to force the shaft 4 against the bias force BF to reduce the length DL and the longitudinal extension 8L allows the operator to exert a force perpendicular to the shaft 4 and move it out of the securing position. Grasping the shaft 4 alone is impractical, since in its operating position the shaft is tucked in the corner of the stair 7 with only approximately half of the circumference available for grasping.

Figure 11:
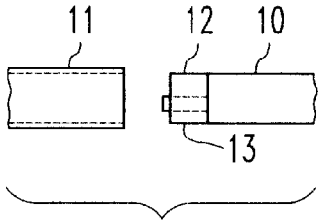
FIGS. 11 and 12 illustrate side and end views of the eccentric lock in the unlocked position.
Figure 13:
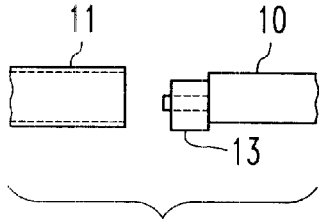
FIGS. 13 and 14 illustrate side and end views of the eccentric lock in the locked position.
Figure 12:
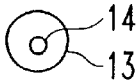
Figure 14:
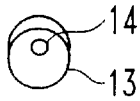
Figure 16:
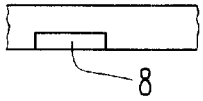
FIGS. 16 and 17 are front and end views of the device of FIG. 15 where the handle extends tangentially outwards from the outer circumference of the shaft.
Figure 17:
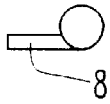

The handle 8 may extend tangentially outwards from the outer circumference of the shaft 4 so as to lay as flat as possible on the surface of the stair 7, as illustrated in FIGS. 16 and 17.

Where the shaft 4 has a rectangular cross-section rather than circular as illustrated, the handle In order to accommodate various widths W of the stair 7 the shaft 4 has a length SL that can be adjusted. The shaft 4 comprises telescoping inner and outer shaft members 10, 11. An eccentric lock 12, illustrated in FIGS. 11–14, is attached to an inside end of the inner shaft member 10 and locks the inner shaft member 10 into position relative to the outer shaft member 12 and releases same to allow adjustment of the shaft length SL. Rotating the inner shaft member 10 relative to the outer shaft member rotates the eccentric member 13 about the offset eccentric shaft 14. Aligning them, as illustrated in FIGS. 11 and 12, releases the inner shaft member 10 to slide in and out of the outer shaft member 11. When the eccentric member 13 is rotated out of alignment, as illustrated in FIGS. 13 and 14, the eccentric member 13 exerts a locking force against the inside wall of the outer shaft member 11.

Figure 3:
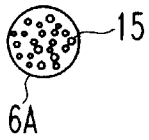
FIG. 3 is an end view of the head of FIG. 2.

The head 6A, illustrated in FIGS. 2 and 3, is adapted to grip a carpeted surface 16 oriented substantially perpendicular to the shaft 4 with sharpened studs 15 extending longitudinally from the head 6A into the carpet when the bias force BF is exerted by the bias element, spring 16, on the head 6A towards the carpeted surface 16.

Figure 4:
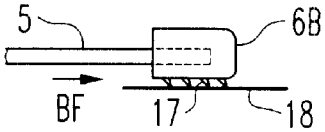
FIGS. 4 and 5 are side and end views of an alternate head for use on a carpeted surface parallel to the shaft.
Figure 5:
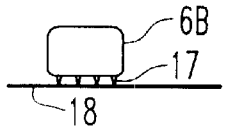

The head 6B, illustrated in FIGS. 4, 5 is adapted to grip a carpeted surface 18 oriented substantially parallel to the shaft 4 with sharpened angled studs 17 extending outward from the shaft 4 into the carpet when the bias force BF is exerted on the head 6B parallel to the carpeted surface 18 and outward from the ends of the shaft 4. As illustrated in FIGS. 4, 5 the sharpened ends of the studs 17 are located substantially on a plane parallel to the carpeted surface 18.

Figure 6:
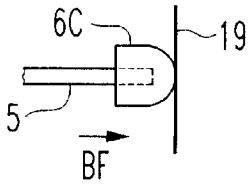
FIGS. 6 and 7 are side and end views of an alternate head for use on smooth surfaces perpendicular to the shaft.
Figure 7:
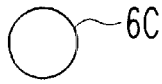

The head 6C, illustrated in FIGS. 6, 7 is resilient and adapted to grip a smooth surface 19, such as wood, linoleum or the like, oriented substantially perpendicular to the shaft 4 by resisting lateral movement when the bias force BF is exerted on the resilient head 6C towards the smooth surface 19.

Figure 8:
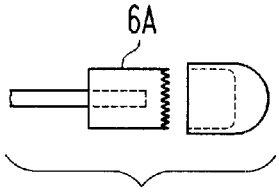
FIGS. 8 and 9 are schematic side views of a cover for converting a studded head to a resilient head.
Figure 9:
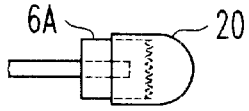
Figure 10:
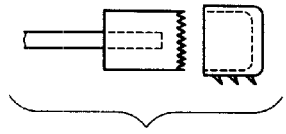
FIG. 10 is a schematic side view of an alternate cover for converting a studded head to an offset studded head.

FIGS. 8 and 9 illustrate a resilient cover 20 releasably attachable to the studded head 6A. The resilient cover 20 is adapted to grip a smooth surface 19 oriented substantially perpendicular to the shaft 4, and essentially allows for quick conversion of the studded head 6A for use on a smooth perpendicular surface 19, similar to head 6C. Similarly FIG. 10 illustrates an offset cover 21 which can convert the studded head 6A for use on a carpeted surface parallel to the shaft 4, similar to head 6B.

Alternatively, to allow for quick change of the heads 6 for use on various surfaces, the heads 6 can be removable from the distal end 5A of the extension member 5. A plurality of interchangeable heads could be provided, each head adapted for gripping a different surface.

With the device 1 of the invention the stair runner 2 may be secured as required by conditions: at every stair 7, or at alternate stairs as illustrated in FIG. 1, or at lesser intervals where the stair runner 2 is less prone to being dislofged. The device 1 will resist movement of the stair runner 2 under normal stresses, and may easily be put back into place if displaced by an unusually high stress. The handle 8 allows the shaft 4 to be pushed longitudinally to retract the extension member 5 and allow installation or removal. Grasping the shaft 4 when in place in the corner of the stair is difficult and impractical without the handle 8. The handle 8 is mounted towards one end of the shaft 4 and lies substantially flat along the horizontal stair or vertical riser, and is thus out of the way of traffic.

Where the end of the stair 7 does not provide a suitable perpendicular surface, or carpeted parallel surface, such as a wooden floor, a plate 22 can be clamped to the staircase to provide a vertical surface, as illustrated in FIG. 1.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A device for temporarily securing a stair runner on a staircase, the device comprising:

an elongated shaft;

an extension member attached to the shaft such that the extension member is movable longitudinally with respect to the shaft, wherein the extension member is biased longitudinally outward from a first end of the shaft, such that the extension member is movable between an extended position and a retracted position;

a second end of the shaft and a distal end of the extension member terminating in a head, the head adapted to grip a surface and resist lateral movement of the head;

wherein a length of the device when the extension member is in the retracted position is less than a width of a stair;

a handle extending substantially radially from the shaft.

2. The device of claim 1 wherein the shaft comprises an adjustment mechanism to allow a length of the shaft to be adjusted.

3. The device of claim 2 wherein the shaft comprises telescoping inner and outer shaft members, and the device further comprises an eccentric lock adapted to lock the inner shaft member into position relative to the outer shaft member, thereby providing the adjustment mechanism.

4. The device of claim 3 wherein the eccentric lock is attached to an inside end of the inner shaft member and exerts a locking force against an inside wall of the outer shaft member.

5. The device of claim 1 wherein at least one head is adapted to grip a carpeted surface oriented substantially perpendicular to the shaft with sharpened studs extending longitudinally from the head into the carpet when a force is exerted on the head towards the carpeted surface.

6. The device of claim 5 further comprising a resilient cover releasably attachable to the at least one head, the resilient cover adapted to grip a smooth surface oriented substantially perpendicular to the shaft by resisting lateral movement when a force is exerted on the resilient head towards the smooth surface.

7. The device of claim 6 further comprising an offset cover releasably attachable to the at least one head, the offset cover adapted to grip a carpeted surface oriented substantially parallel to the shaft with sharpened studs extending outward from the shaft into the carpet when a force is exerted on the head parallel to the carpeted surface.

8. The device of claim 7 wherein sharpened ends of the studs are located substantially on a plane parallel to the carpeted surface.

9. The device of claim 1 wherein at least one head is resilient and adapted to grip a smooth surface oriented substantially perpendicular to the shaft by resisting lateral movement when a force is exerted on the resilient head towards the smooth surface.

10. The device of claim 1 wherein at least one head is adapted to grip a carpeted surface oriented substantially parallel to the shaft with sharpened studs extending outward from the shaft into the carpet when a force is exerted on the head parallel to the carpeted surface and outward from the ends of the shaft.

11. The device of claim 10 wherein sharpened ends of the studs are located substantially on a plane parallel to the carpeted surface.

12. The device of claim 1 wherein at least one head is removable, and further comprising a plurality of interchangeable heads, each head adapted for gripping a different surface.

13. The device of claim 1 wherein the extension member is located in a hollow portion in the first end of the shaft, and further comprising a spring mounted in the hollow portion and exerting an outward bias force on the extension member.

14. The device of claim 1 wherein the handle curves towards the second end of the shaft as it extends substantially radially from the shaft.

15. The device of claim 1 wherein the handle includes a surface that extends tangentially outwards from an outer circumference of the shaft.

* * * * *